US005823379A

United States Patent [19]

Friedlander et al.

[11] Patent Number: 5,823,379

[45] Date of Patent: Oct. 20, 1998

[54] SEALED CONTAINER FOR HAZARDOUS MATERIAL

[75] Inventors: Uri Friedlander, London; Richard Ashley Stubbs, Tring, both of United Kingdom

[73] Assignee: Amersham International plc, Buckinghamshire, United Kingdom

[21] Appl. No.: 861,850

[22] Filed: May 22, 1997

Related U.S. Application Data

[63] Continuation of Ser. No. 416,896, filed as PCT/GB94/02288 Oct. 19, 1994 published as WO95/11511 Apr. 27, 1995, abandoned.

[30] Foreign Application Priority Data

Oct. 20, 1993 [GB] United Kingdom ..... 9321612

[51] Int. Cl.[6] ..... B65D 43/04

[52] U.S. Cl. ..... 220/408; 220/284; 215/297; 215/302; 215/320

[58] Field of Search ..... 220/403, 404, 220/408, 410, 284; 215/12.1, 247, 254, 256, 296, 297, 302, 320

[56] References Cited

U.S. PATENT DOCUMENTS

| | | | |
|---|---|---|---|
| 4,098,417 | 7/1978 | Bennett | 215/296 |
| 4,958,666 | 9/1990 | Kocourek et al. | 220/404 |
| 5,004,126 | 4/1991 | Klesius | 215/256 |
| 5,031,519 | 7/1991 | Toida et al. | 220/408 |
| 5,118,003 | 6/1992 | Pepper et al. | 220/404 |
| 5,167,929 | 12/1992 | Korf et al. | 220/410 |
| 5,332,113 | 7/1994 | Kusler, III et al. | 215/247 |
| 5,397,020 | 3/1995 | Witt | 220/404 |
| 5,425,469 | 6/1995 | Freedland | 220/404 |

FOREIGN PATENT DOCUMENTS

| | | | |
|---|---|---|---|
| 28411 | 5/1981 | European Pat. Off. | 215/247 |
| 1324160 | 3/1963 | France . | |
| 2221356 | 3/1973 | France | 215/296 |
| 2369976 | 7/1978 | France | 215/296 |

*Primary Examiner*—Stephen J. Castellano
*Attorney, Agent, or Firm*—Wenderoth, Lind & Ponack, L.L.P.

[57] ABSTRACT

A container suitable for use in the transportation of hazardous materials, for example radiolabelled material, has a base cup member (12) which is closed by a threaded lid (13). Within the cup member (12) a liner (17) is provided within an inner cavity (16). The liner (17) is suspended from an end flange (18) which is in engagement with the upper face of the rim of the cup member (12). The liner (17) has an annular shoulder (23) spaced from the end flange (18). The shoulder (23) is arranged so that it engages and thereby seals with the head (26) of a closure element (25). The closure element (25) also includes an engagement recess (31) to enable it to be removed from the liner (17). The container is usually mounted within a two-part inner casing (10*a*, 10*b*) which in turn is positioned within an outer casing (11*a*, 11*b*). With the container described hazardous materials even in liquid form may be stored and transported safely as desired without the need for bulky packaging.

11 Claims, 2 Drawing Sheets

SEALED CONTAINER FOR HAZARDOUS MATERIAL

This application is a continuation of now abandoned application, Ser. No. 08/416,896, filed on Apr. 18, 1995 now abandoned which is a 371 of PCT/GB94/02288 filed Oct. 19, 1994 published as WO95/11511 Apr. 27, 1995.

BACKGROUND OF THE INVENTION

This invention relates to containers and has a particularly useful but not exclusive use in relation to containers for the shipment of radiolabelled and other hazardous materials. These containers in some instances carry only a few microlitres.

In the case of radiolabelled compounds such as 32P-, 33P- and 35S-labelled nucleotides, the compounds have hitherto been transported from the site of manufacture to the end user at low temperatures (for example packed in dry ice at a temperature of −70° C. to −80° C.) to minimize radiochemical decomposition and this has resulted in bulky packaging which is inconvenient for disposal by users.

SUMMARY OF THE INVENTION

We have recently developed novel formulations of these substances which exhibit marked thermal stability at temperatures as high as 40° C. and these new substances can therefore be transported in liquid form at ambient temperatures with the following advantages:

(i) the substances can be supplied in small more "environmentally-friendly" packages instead of in bulky expanded polystyrene vessels containing dry ice, (ii) reductions in package weight and the fact that there is no longer a need to use dry ice can provide savings in packaging and shipping costs, and (iii) the end user can sample the product immediately upon receipt, without the need for a lengthy thawing step.

A pre-requisite of ambient shipment of radiochemical liquids is the development of primary packaging in which the liquid is contained in the desired position during shipment and is readily and safely accessible to the user upon opening. This is not an issue with dry ice shipment where the product is frozen at the base of the primary "v-vial" commonly used in such packages.

According to the present invention there is provided for a container having internally thereof a cavity opening to a neck portion of the container and a cap releasably secured on the neck, a liner adapted for disposition in the cavity and having an end flange arranged for engagement on the end of the neck, the liner having internally thereof and spaced from the inner end thereof an annular shoulder facing towards said end flange, and a sealing element for sealing the inner end portion of the liner and comprising a head adapted to form a seal with said shoulder and a stem extending along the liner for engagement with the underside of the cap whereby the cap operates to press said head into sealing engagement with said shoulder.

The invention also provides a container having a neck to which opens a cavity formed in the container a cap releasably secured on said neck and covering the opening to said cavity, a liner disposed within the cavity and having an end flange by which the liner is supported from the upper end of the neck, the liner having internally thereof and spaced from its inner end an annular shoulder facing towards said end flange, and a sealing element having a head adapted to abut the shoulder and to form a liquid-tight seal therewith and a stem extending towards said end flange, the outer end of the stem being arranged for engagement with the underside of the cap such that when the cap is secured on said neck the head of the closure element is held in sealing engagement with the shoulder.

BRIEF DESCRIPTION OF THE DRAWINGS

Two embodiments of the invention will now be described by way of example. The description makes reference to the accompanying drawings in which.

DETAILED DESCRIPTION OF THE INVENTION

In each of the two embodiments the container is shown removably disposed in a two-part inner casing 10*a*, 10*b* which is in turn disposed in a multi-part outer casing 11*a*, 11*b* incorporating lead shielding.

Figure 1:
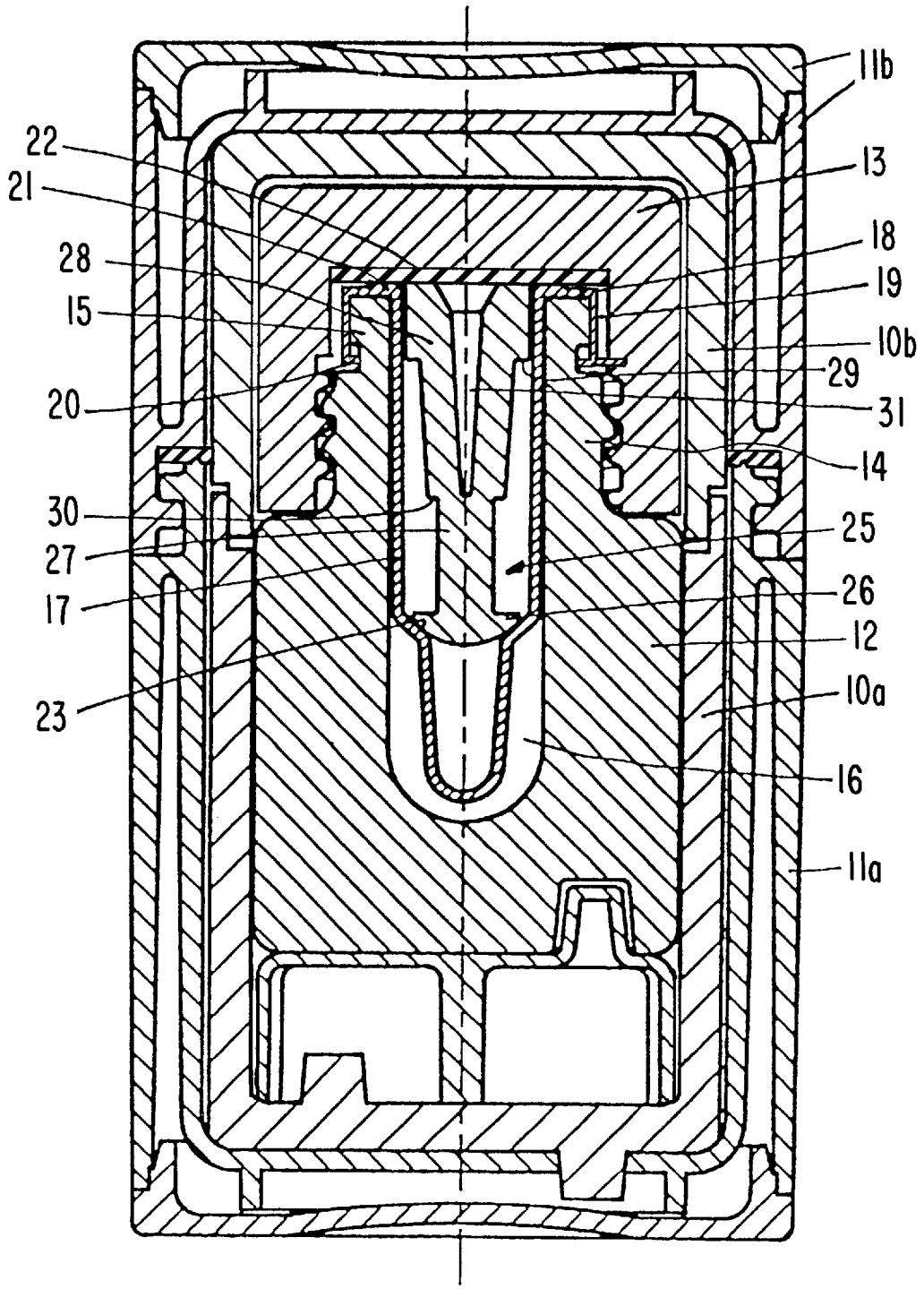
FIGS. 1 and 2 respectively show in sectional elevation two containers according to the invention.

Referring now to FIG. 1 of the drawings the container has a base part 12 formed from a transparent plastics material such as acrylic and providing an internal cavity (or recess) 16, and a screw-cap 13 engaged on a screw-threaded collar portion 14 of the neck of the container. Spaced above the collar 14 the neck has a radially thickened end-part 15.

The cavity 16 of the container is of generally cylindrical form with a rounded inner end, and a translucent liner 17 in the form of a v-vial made from a plastics material such as polypropylene is suspended by an end flange 18 thereof within the cavity. The end flange 18 of the liner rests on the top of the neck and has a down-turned skirt 19 which fits against the radially outer surface of the thickened end part 15 of the neck and which has an inturned lip 20 below the part 15. The end flange has an integral upstanding annular land 21 which is abutted by a gasket 22 contained within the cap 13. The upper portions of the liner 17 are disposed close to the wall of the recess 16, but the lower portions of the liner are of reduced diameter and are spaced away from the wall of the recess.

The liner has spaced above its rounded lower or inner end an annular internal shoulder 23 facing towards the neck and a sealing element 25 extending along the liner has a head 26 which abuts the shoulder to form a seal. The shoulder 23 is substantially conical and the contacting surface of the head is part-spherical. The stem 27 of the sealing element is of much smaller diameter than the liner except at its outer end where it has an increased diameter portion 28 which is a loose fit against the internal surface of the liner and which provides an annular shoulder 29 at its inner end. The sealing element has a further annular shoulder 30 disposed inwardly of the shoulder 29 and facing towards the head 26. The upper end of the portion 28 abuts the gasket 22. An elongate conical recess engagement 31 is formed in the upper end of the portion 28, and, when the cap 13 has been removed, is frictionally engageable by the correspondingly conical end of a rod-like implement e.g. a pipette tip (not shown) to enable the sealing element 25 to be lifted out of the cavity.

Figure 2:
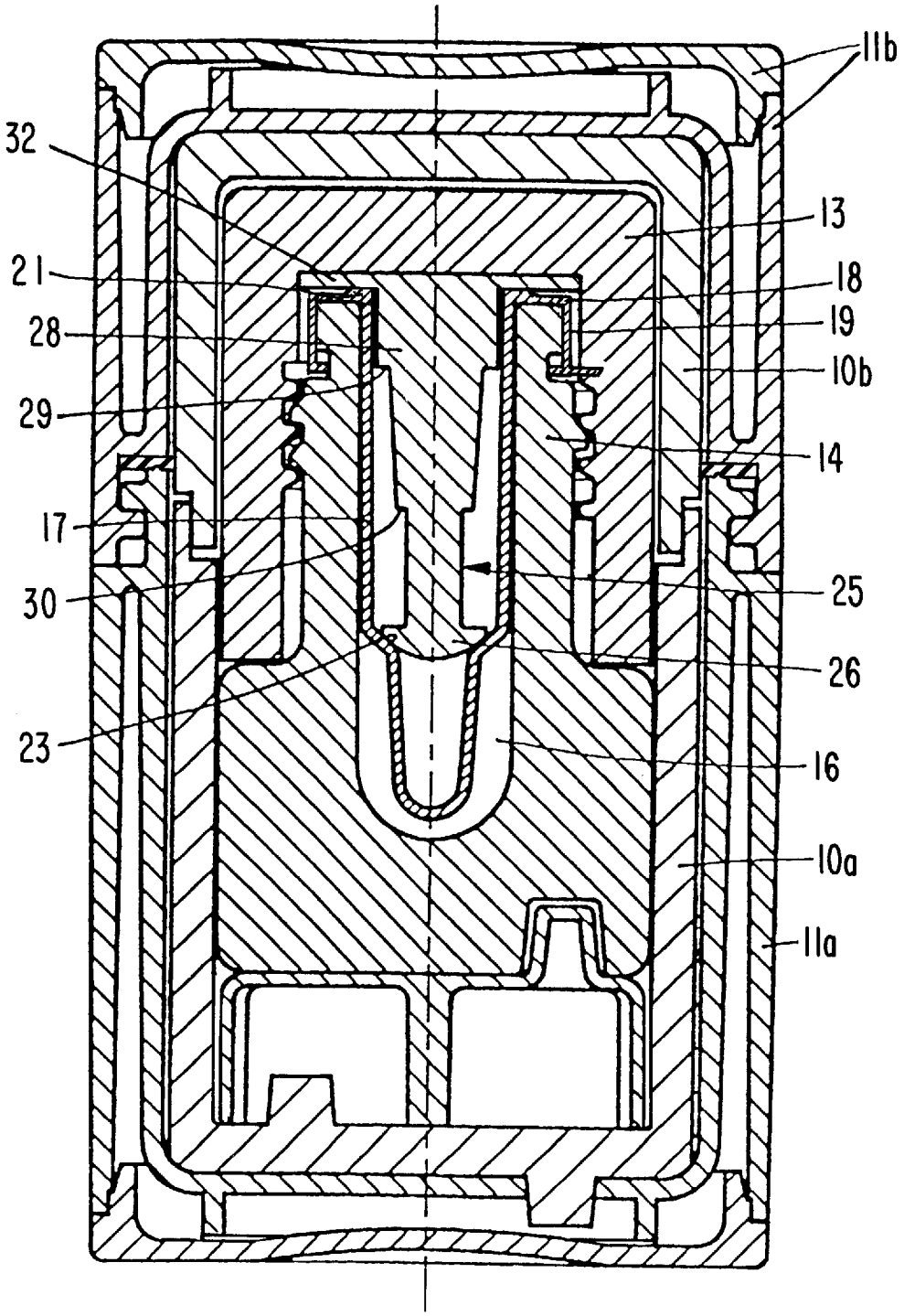

The construction illustrated in FIG. 2 is generally similar to that shown in FIG. 1 and corresponding components are indicated by corresponding reference numerals. In the arrangement of FIG. 2, however, the sealing element 25 is attached to the underside of the cap 13. For this purpose no gasket is provided on the underside of the cap, and the upper end of the sealing element 25 extends upward beyond the end flange 18 and has an end portion 32 the outer diameter of which is an interference fit within the side wall of the cap. Alternatively the upper end of the sealing element may be bonded to the underside of the cap. The underside of the enlarged end portion 28 of the sealing element abuts the sealing land 21 on the end flange of the liner.

In the arrangement of FIG. 1 the sealing element 26 can be placed in a centrifuge tube to enable liquid remaining on the sealing element to be collected in the bottom of the centrifuge tube.

In both of the illustrated constructions the liquid to be transported is safely sealed in the bottom end of the cavity in the liner by the head 26 of the sealing element, and access to the liquid by means of a pipette for example is opened when the cap 13 and the sealing element 25 have been removed.

The colorless transparency of the container and the colorless translucency of the liner enable a color coding of the liquid to be used to identify the liquid in the container, if desired.

In some circumstances the container can be used without the inner and outer casings 10*a*, 10*b*, 11*a* and 11*b*.

The containers particularly described above provide a suitable means of transporting small volumes of potentially hazardous liquid materials in a container which has a much larger cavity. This large cavity provides greater convenience of operation. The ratio of liquid to total cavity volume can be typically in the range 1:2 to 1:100.

We claim:

1. A container defining a cavity with an opening to a neck, and having a cap releasably secured on the neck covering the opening, a liner disposed within the cavity and including an end flange by which the liner is supported from the upper end of the neck, an inner end, a liquid containing cavity at the inner end, an annular shoulder located internally and spaced from the inner end, the annular shoulder facing towards the end flange, and a sealing element comprising a head adapted to abut the annular shoulder and to form a liquid-tight seal therewith and a stem extending towards the end flange, an outer end of the stem being arranged for engagement with an underside of the cap such that when the cap is secured on the neck the head of the sealing element is held in sealing engagement with the annular shoulder, wherein said stem of said sealing element is smaller in outer diameter than said head of said sealing element, and said stem extends away from said head for engagement with an underside of the cap.

2. A container device for the storage and transportation of hazardous liquids, comprising:

a container part having an exterior surface, and an interior surface defining a cavity having an opening through said exterior surface;

a cap releasably securable to said exterior surface in covering relation to said opening of said cavity;

a liquid containing vial removably disposed within said cavity, said vial having an inner surface, an outer surface, an upper portion engaged with said interior surface of said container part, an annular shoulder having an inner surface facing towards said upper portion and an outer surface spaced inwardly from and being free of said interior surface of said container part, and a lower portion depending from said annular shoulder; and a sealing element removably disposed within said vial, said sealing element having a head for contacting against and forming a liquid-tight seal with said annular shoulder of said vial, and a stem extending away from said head, said sealing element including removal means for enabling removal of said sealing element from said vial and thereby providing access to liquid contained within said vial without removal of said vial from said cavity.

3. A container device as claimed in claim 2, wherein said removal means comprises a tool-engagement recess formed in an end of said sealing element opposite said head.

4. A container device as claimed in claim 3, wherein said tool-engagement recess is conical.

5. A container device as claimed in claim 2, wherein said removal means comprises an end portion of said sealing element, said end portion being disposed at least partially above said vial and outside of said cavity.

6. A container device as claimed in claim 5, wherein said end portion of said sealing element is one piece with said stem of said sealing element.

7. A container device as claimed in claim 2, wherein said lower portion of said vial is spaced inwardly from and free of said interior surface of said container part.

8. A container device for the storage and transportation of hazardous liquids, comprising:

a container part having an exterior surface, and an interior surface defining a cavity having an opening through said exterior surface;

a cap releasably securable to said exterior surface in covering relation to said opening of said cavity;

a liquid containing vial removably disposed within said cavity, said vial having an inner surface, an outer surface, an upper portion engaged with said interior surface of said container part, an annular shoulder having an inner surface facing towards said upper portion and an outer surface spaced inwardly from and being free of said interior surface of said container part, and a lower portion depending from said annular shoulder; and a sealing element removably disposed within said vial, said sealing element having a head for contacting against and forming a liquid-tight seal with said annular shoulder of said vial, a stem extending away from said head, and an end portion which is one piece with said stem and is disposed at least partially above said vial and outside of said cavity so as to constitute a sealing element removal portion.

9. A container device as claimed in claim 8, wherein said end portion of said sealing element is secured to said cap such that, upon removal of said cap from said container part, said sealing element is removed from said vial.

10. A container device as claimed in claim 8, wherein said lower portion of said vial is spaced inwardly from and free of said interior surface of said container part.

11. A container device as claimed in claim 8, wherein an outer end of said upper portion of said vial extends above said container part, and said end portion of said sealing element is removably adjoined with said outer end of said end portion of said vial.

* * * * *